US006319156B1

(12) United States Patent
Alexsen

(10) Patent No.: US 6,319,156 B1
(45) Date of Patent: Nov. 20, 2001

(54) BIODEGRADABLE GOLF TEE

(75) Inventor: Andre Alexsen, Agoura Hills, CA (US)

(73) Assignee: John Marshall, Beverly Hills, CA (US)

( * ) Notice: Subject to any disclaimer, the term of this patent is extended or adjusted under 35 U.S.C. 154(b) by 0 days.

(21) Appl. No.: 09/459,277

(22) Filed: Dec. 13, 1999

(51) Int. Cl.[7] ..... A63B 57/00
(52) U.S. Cl. ..... 473/399
(58) Field of Search ..... 473/399, 387

(56) References Cited

U.S. PATENT DOCUMENTS

| | | | | |
|---|---|---|---|---|
| 702,078 | * | 6/1902 | Stockder, Jr. | 473/399 |
| 4,014,541 | * | 3/1977 | Desmarais | 473/399 |
| 4,126,438 | | 11/1978 | Pulli et al. | 473/399 |
| 4,747,868 | * | 5/1988 | Schmierer et al. | 504/193 |
| 4,960,279 | * | 10/1990 | Harris, Jr. | 473/251 |
| 4,969,946 | * | 11/1990 | Arndt et al. | 71/11 |
| 5,040,792 | * | 8/1991 | Takigawa | 473/399 |
| 5,046,730 | * | 9/1991 | Golden et al. | 473/399 |
| 5,147,442 | * | 9/1992 | Kosuge et al. | 71/27 |
| 6,110,866 | * | 8/2000 | Walker | 504/118 |
| 6,171,358 | * | 1/2001 | Obrestad et al. | 71/62 |
| 6,176,891 | * | 1/2001 | Komoriya et al. | 71/11 |
| 6,187,710 | * | 2/2001 | Vogels et al. | 502/80 |

* cited by examiner

*Primary Examiner*—Steven Wong
(74) *Attorney, Agent, or Firm*—Matthew A. Newboles; Stetina Brunda Garred & Brucker

(57) ABSTRACT

A biodegradable golf tee having fertilizer properties and method of making the same. According to a preferred embodiment, the golf tee comprises the combination of bentonite, potassium nitrate, and sodium nitrate that are formed into the configuration of a conventional golf tee. Optionally, sodium nitrate, sand, or a pigment, such as chromium (III) oxide, may further be added. The golf tee is specifically designed to degrade when contacted with water or atmospheric air having a humidity of at least 20% or higher. The biodegradable golf tee may further be modified to include soil modifying agents, such as gypsum, as well as grass seed. The invention further comprises methods for forming the biodegradable golf tees of the present invention.

7 Claims, No Drawings

BIODEGRADABLE GOLF TEE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

Essential to playing the sport of golf is the golf tee. As is well-known, the tee is utilized to prop up the golf ball above the surface of the ground to thus place the ball in optimal positioning during the initial shot from the tee box of a given hole. Typically, golf tees are made of wood or plastic, and are known to have extremely limited life spans insofar as the impact from the golf club thereagainst can, and almost always does, cause the tee to break or become permanently deformed. Indeed, it is not uncommon for golfers to utilize more than a dozen or so golf tees for a single round of golf.

As a consequence, the golf course, and more particularly the respective tee boxes of the respective holes of a given golf course, can and frequently do rapidly accumulate significant numbers of broken tees that become scattered thereabout. Such scattered tees are not only unsightly and require significant effort to insure that the same do not overly accumulate, but further can cause substantial damage to the golf course itself. In this regard, it is known that such golf tees can become deeply embedded within the tee box, which thus impedes the growth of grass. The latter phenomenon is especially likely due to the frequency by which divots are created as part of the tee-off shot. Indeed, it is widely recognized that the problem posed by broken tees often creates a situation where golfers may find it difficult to even find a suitable area upon the tee box from which to tee off. Moreover, the practice of using easily breakable and difficult to remove golf tees causes the respective tee boxes of the holes of a golf course, to become unsightly, which thus thwarts their aesthetic appeal and value added to the community.

In an attempt to address such problems, it is known in the art to attempt to manufacture golf tees from inert or biodegradable substances. For example, it is known to form golf tees out of compressed sawdust such that over time, the golf tee can disintegrate and blend into the soil. Problematic of such golf tees, however, is the fact that the same do not facilitate the re-growth of grass. Moreover, such golf tees further require prolonged periods of time by which the same achieve their intended purpose of disintegrating or otherwise becoming integrated into the soil. Accordingly, for the most part, such golf tees are generally no better than conventional tees.

Another practice employed to address the foregoing problems is to require golfers to repair the divots made in the tee box by virtue of the tee-off shot or, alternatively, pour a mixture of grass seed and sand at the site at which the divot was made. Although ideal for preserving the integrity of the golf course, and in particular the grounds of the tee-off boxes, such practice is problematic insofar as it relies upon the individual golfers to implement and abide by such procedures, and hence is unreliable. Furthermore, such practice is deficient insofar as the same does not address the issue of golf tees or portions thereof that become embedded within the surface of the tee box and remain therein for prolonged periods of time, if not indefinitely.

Accordingly, there is a need in the art for a biodegradable golf tee that easily and readily decomposes shortly after use. There is a further need in the art for a biodegradable golf tee that can actually improve the quality of the soil within which the same is embedded and, in particular, provide a fertilizing effect to grass planted therearound. There is still further need in the art for a biodegradable golf tee that, in addition to the foregoing properties, is capable of functioning as per conventional golf tees, and can be readily and easily utilized thereinstead.

BRIEF SUMMARY OF THE INVENTION

The present invention specifically addresses and alleviates the above-identified deficiencies in the art. In this regard, the present invention is directed to a biodegradable golf tee that further acts as a source of fertilizer for grass and other types of vegetation. In a preferred embodiment, the golf tee comprises a mixture of bentonite, potassium nitrate ($KNO_3$), and sodium nitrate ($NaNO_3$) that is formed into the shape of a conventional golf tee. Optionally, sodium nitrite ($NaNO_2$) and chromium (III) oxide ($Cr_2O_3$) may be added, respectively. According to a preferred embodiment, the bentonite is present in an amount from 80.0% to 5.0% by weight, the potassium nitrate is present in an amount from 78.0% to 5.0% by weight, and the sodium nitrate is present in an amount from 65.0% to 5.0%. Optionally, the sodium nitrate is present in an amount from 55.0% to 0.1% by weight, and the chromium (III) oxide is present in an amount from 0.4% to 0.1% by weight. In a more highly preferred embodiment, the golf tees are comprised of a mixture of bentonite being present in an amount of 50%±5% by weight, potassium nitrate being present in an amount of 25.0%±5.0% by weight, the sodium nitrate component is present in an amount of 25.0%±5.0% by weight. Such embodiment may further optionally include sodium nitrite being present in an amount of approximately 7.06%±0.1% by weight and chromium (III) oxide being present in an amount of approximately 0.1%. The biodegradable golf tees are preferably formed to rapidly melt and become dissolved into the surrounding soil as soon as 10 minutes once the golf tee comes into contact with water. The golf tees of the present invention may further be designed to decompose rapidly over the space of 24–48 hours when merely contacted with atmospheric air having a humidity of approximately 20% to 30%. In this regard, the golf tees of the present invention are specifically formulated to selectively change properties from a solid golf tee structure into its individual chemical components shortly after use thereof.

In addition to providing a rapidly degradable, fertilizing golf tee, it is contemplated that the golf tees of the present invention may further be modified to include sand or other soil enhancement agents, such as gypsum ($CaSO_4$), grass seed, or combinations thereof. The present invention further comprises a process for manufacturing the biodegradable golf tees of the present invention comprising the steps of combining quantities of bentonite potassium nitrate, and sodium nitrate in a low-humidity environment to form a first admixture wherein the bentonite is present in an amount ranging from 80.0% to 5.0% by weight, the potassium nitrate is present in an amount from 78.0% to 5.0% by weight, and the sodium nitrate is present in an amount from 65.0% to 5.0%. Optionally, sodium nitrate and/or chromium (III) oxide may be added, respectively, to the first admixture such that the sodium nitrite is present in an amount from 55.0% to 0.1% by weight and the chromium (III) oxide is present in an amount from 0.4% to 0.1% by weight. The admixture is heated to approximately 300° F. for a sufficient time until the admixture becomes molten. The molten admixture is thereafter molded into the configuration of a conventional golf tee and allowed to cool to room temperature. Once sufficiently cool, the golf tees may be utilized for their intended purpose provided, however, that the same are kept in a low-humidity environment (i.e., contained in packaging having low humidity) until the same are to be utilized as per conventional golf tees.

It is therefore an object of the present invention to provide a biodegradable golf tee that easily and rapidly degrades from a golf tee configuration into a variety of inert and/or soil-enhancing substances.

Another object of the present invention is to provide a biodegradable golf tee that is effective in fertilizing grass and other vegetation.

Another object of the present invention is to provide a biodegradable golf tee that is capable of functioning as per conventional golf tees.

Still further objects of the present invention are to provide a biodegradable golf tee that is easy and inexpensive to manufacture, can be easily and readily utilized, substantially minimizes damage to golf courses as per conventional golf tees, and preserves and enhances the turf of a golf course.

BRIEF DESCRIPTION OF THE SEVERAL VIEWS OF THE DRAWING (Not applicable)

DETAILED DESCRIPTION OF THE INVENTION

The detailed description as set forth below in connection with the appended drawings is intended as a description of the presently preferred embodiments of the invention, and is not intended to represent the only form in which the present invention may be constructed or utilized. The description sets forth the functions and sequences of steps for constructing and operating the invention in connection with the illustrated embodiments. It is understood, however, that the same or equivalent functions and sequences may be accomplished by different embodiments and that they are also intended to be encompassed within the scope of this invention.

The present invention comprises a biodegradable golf tee having fertilizer properties whose purpose is to rapidly degrade into its chemical components after being subjected to water or air having moderate to high humidity. In this regard, the biodegradable golf tees of the present invention are specifically directed towards alleviating problems associated with conventional wooden and plastic golf tees which have a tendency to break off and become embedded into the tee boxes of the various holes played on a golf course. Such prior art tees are known to rapidly accumulate, become unsightly, and cause significant damages to golf courses requiring substantial expense and effort to remove the same in order to preserve the integrity of the tee box.

The biodegradable golf tees of the present invention, in contrast, are specifically designed and formulated to not only avoid damaging golf courses as per conventional tees, but actually preserve and facilitate the restoration of the tee boxes where golf tees are utilized. The basic three (3) components that comprise this invention, and their respective percentage by weight thereof, encompass the following ranges:

TABLE 1

| COMPONENTS | PERCENT BY WEIGHT |
|---|---|
| Potassium Nitrate | 78.0% to 255.0% |
| Sodium Nitrate | 65.0% to 155.0% |
| Bentonite | 80% to 5% |

It is understood that percentages of the three (3) components above will total 100% by weight, and if other materials are included in the formulation, the percentages of all ingredients will total 100% by weight. In this regard, there my optionally be provided sodium nitrite, which may be present in an amount ranging from 55.0% to 0.1%, as well as a pigment, and in particular chromium (III) oxide, which may be present in an amount ranging from 0.4% to 0.1%.

All of the aforementioned components comprise high-grade commercial quality compounds that may be readily obtained from commercial sources, such as Chilean Nitrate Corp., BASF Nitrite, or L.A. Chemical Co. The method of forming the biodegradable golf tees of the present invention is discussed more fully below.

When formed to have the aforementioned components in the quantities falling within the aforementioned ranges of Table 1, the biodegradable golf tees of the present invention are shown to rapidly decompose and degrade into their various sub-components upon contact with water, as would occur in use when the ground of the golf course, and more particularly the tee boxes thereof within which the golf tees of the present invention would be embedded, are contacted with water, such as rain or an irrigation source, such as sprinklers and the like.

In this regard, it is currently believed that the golf tees of the present invention can become completely molten and solubilized within 10 to 90 minutes after being contacted with water. On average, it has been found that the golf tees of the present invention became completely molten within 60 minutes. In fact, the biodegradable golf tees of the present invention are further shown to further decompose into their various sub-components within 24–48 hours by merely being left exposed to atmospheric air having a humidity of approximately 20% to 30%. Advantageously, even to the extent the biodegradable golf tees of the present invention are not fully saturated with water applied thereto from an outside source, the golf tees will nonetheless completely disappear and dissolve into the aforementioned compounds by virtue of simply being exposed to air. As a result, the golf tees of the present invention, or any portion thereof, do not persist and remain embedded within the soil of the tee box for any appreciable length of time.

As will thus be appreciated, in any formulation of the golf tees of the present invention, any resultant composition from which the golf tees are formed will have the desired phase change property of remaining in a solid phase when maintained in a water-free environment, but become plastic, and thereafter become soluble, when the golf tees are eventually subjected to a humid or wet environment. It will additionally be recognized that, in addition to the aforementioned components, other additional components may be added, such as soil additives such as gypsum, or grass seed, to thus further provide additional soil improvement properties as may be desired. Along these lines, the chromium (III) oxide component of the present invention is provided merely to produce a green pigment to thus give the golf tees an aesthetically pleasing appearance. It will be understood that a variety of compounds may be substituted for the chromium (III) oxide to thus produce a given color for a given golf tee product. Indeed, it will be recognized that such pigment component may be dispensed with altogether and that the golf tees of the present invention need only be comprised of bentonite potassium nitrate, and sodium nitrate.

In a more highly preferred embodiment of the present invention, the golf tee comprises:

TABLE 2

| COMPONENTS | PERCENT BY WEIGHT |
|---|---|
| Bentonite | 50.0% ± 5.0% |
| Potassium Nitrate | 25.0% ± 5.0% |
| Sodium Nitrate | 25.0% ± 5.0% |

When formulated to have the components in the aforementioned specified amounts, the biodegradable golf tees of the present invention are shown to become molten and dissolve as quickly as 10 minutes after being immersed within water, and dissolve sufficiently into soil when subjected to atmospheric air having a humidity of approximately 30% for approximately 24–48 hours. As per the first embodiment, the second embodiment may be comprised of readily available commercial chemical products produced by L.A. Chemical Co., BASF, or Chilean Nitrate Corp. In this respect, it should further be recognized that a pigment such as chromium (III) oxide may added to the components listed in Table 2.

With respect to the aforementioned embodiments, all may be prepared as follows. The process of formulating the biodegradable golf tees of the present invention comprises the initial step of combining all of the components together to form a first admixture. Because sodium nitrate is known to rapidly absorb water from the air, it will be necessary to mix such components in an environment having a low humidity, which preferably would not exceed 10%. To the extent excessive humidity is present, the admixture will eventually foam and thus will be rendered unusable.

Once the dry materials have been sufficiently mixed with one another to form the first admixture, the resultant admixture is heated to around 300° F. for approximately 10 minutes. By virtue of the fact that most sodium nitrate is produced in the form of small "prills," it will be understood that the resultant admixture may require heating at 300° F. for longer periods of time until the admixture melts and becomes molten. However, efforts should be made to insure that the components are not mixed at excessively high temperatures ranging from 500° to 600° F. or higher insofar as such elevated temperatures can cause the components to chemically degrade.

Once in such molten state, the admixture can be molded into the shape of conventional golf tees, the dimensions of which are well-known. Such molding process may take the form of any molding processes known in the art, including injection molding utilized to form plastic items and the like. Once molded into the appropriate configuration, the admixture is allowed to cool and re-solidify in the molded golf tee configuration. Advantageously, the golf tees of the present invention, after having been so formed, can again be re-heated and re-molded to the extent it is necessary to reconfigure the same. It should be understood, however, to the extent the molten admixture comes into contact with any type of organic substance, as may occur during the molding process while the golf tees are cooled, that the resultant product should not be reheated.

Once the golf tees of the present invention have been properly formed, the same will preferably be packaged in a manner such that the same are kept in a low-humidity environment. Such packaging techniques may take the form of any well-known in the art, including shrink wrap packaging utilized in the food and fertilizer industries. When so kept in a low-humidity environment, the biodegradable golf tees of the present invention will retain their rigid structure until such time as the golf tees are removed from such low-humidity environment and utilized for their intended purpose to tee-up a golf ball. Due to the inert nature of the components of the present invention, the golf tees of the present invention may be handled as per conventional golf tees with the exception that the user should be mindful of the rapid nature by which the golf tees of the present invention dissolve once contacted with water. In this regard, it will be appreciated by those skilled in the art that the golf tees of the present invention should be handled and promptly utilized once removed from the packaging within which the golf tees are contained. Moreover, common sense should dictate that such golf tees should not be placed in the user's mouth or otherwise placed within or near beverages.

Although the invention has been described herein with specific reference to a presently preferred embodiment thereof, it will be appreciated by those skilled in the art that various modifications, deletions, and alterations may be made to such preferred embodiment without departing from the spirit and scope of the invention. For example, it will be understood that inert ingredients may be added to the golf tees of the present invention, such as sand, which may thus impart added rigidity. In such applications, it is believed that the sand component may be present in an amount of 75.0% to 0.1% by percent weight of the golf tees of the present invention. Accordingly, it is intended that all reasonably foreseeable additions, modifications, deletions and alterations be included within the scope of the invention as defined in the following claims.

What is claimed is:

1. A biodegradable golf tee comprising:

a) 39.9% to 5.0% by weight of bentonite;

b) 78% to 5.0% by weight of potassium nitrate;

c) 65.0% to 5.0% by weight of sodium nitrate; and d) 55.0% to 0.1% by weight of sodium nitrite.

2. The biodegradable golf tee of claim 1 further comprising:

d) 0.4% to 0.1% by weight of chromium (III) oxide.

3. The biodegradable golf tee of claim 2 wherein said chromium (III) oxide is present in an amount of approximately of 0.1% by weight.

4. The biodegradable golf tee of claim 2 further comprising:

e) 75.0% to 0.1% by weight of sand.

5. The biodegradable golf tee of claim 4 further comprising:

e) 75.0% to 0.1% by weight of a soil additive.

6. The biodegradable golf tee of claim 5 wherein said soil additive comprises gypsum.

7. A biodegradable golf tee comprising:

a) 50.0%±5.0% by weight of bentonite;

b) 25.0%±5.0% by weight of potassium nitrate;

c) 25.0%±5.0% by weight of sodium nitrate;

d) 0.4%±0.1% by weight of chromium (III) oxide;

e) 75.0%±0.1% by weight of sand; and f) 75.0%±0.1% by weight of a soil additive.

* * * * *